United States Patent [19]

Mima

[11] 4,433,534

[45] Feb. 28, 1984

[54] APPARATUS FOR SPLICING SPUN YARNS

[75] Inventor: Hiroshi Mima, Kyoto, Japan

[73] Assignee: Murata Kikai Kabushiki Kaishba, Japan

[21] Appl. No.: 296,448

[22] Filed: Aug. 26, 1981

[30] Foreign Application Priority Data

Aug. 26, 1980 [JP] Japan ..... 55-118078

[51] Int. Cl.[3] ..... D01H 15/00

[52] U.S. Cl. ..... 57/22; 57/261; 57/263

[58] Field of Search ..... 57/22, 23, 261, 263, 57/908, 350

[56] References Cited

U.S. PATENT DOCUMENTS

| | | | |
|---|---|---|---|
| 3,474,615 | 10/1969 | Irwin et al. | 57/22 X |
| 3,487,618 | 1/1970 | Arguelles | 57/22 |
| 4,002,012 | 1/1977 | Norris et al. | 57/22 |
| 4,217,749 | 8/1980 | Rohner et al. | 57/22 |
| 4,232,509 | 11/1980 | Rohner et al. | 57/22 X |
| 4,246,744 | 1/1981 | Matsui et al. | 57/22 |
| 4,292,796 | 10/1981 | Mima | 57/22 |

*Primary Examiner*—Donald Watkins

*Attorney, Agent, or Firm*—Barnes, Kisselle, Raisch, Choate, Whittemore & Hulbert

[57] ABSTRACT

A pneumatic yarn splicing apparatus 12 for spun yarns comprises a yarn quiding means 24, 25, yarn-cutting devices 22, 23, yarn end control nozzles 20, 21 and a yarn-splicing member 19. The yarn-splicing member 19 includes a flat jet nozzle 35 opened on a yarn-splicing hole 33 perforated through the yarn-splicing member 19.

7 Claims, 24 Drawing Figures

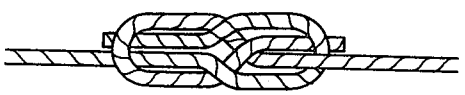
FIG. 1-b
PRIOR ART
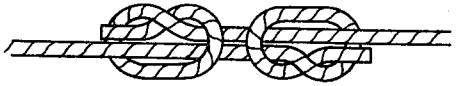
FIG. 1-a
PRIOR ART
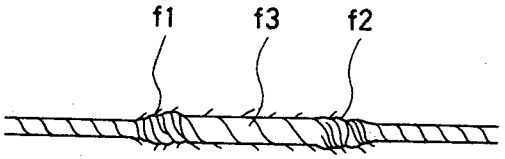
FIG. 1-c

FIG. 9
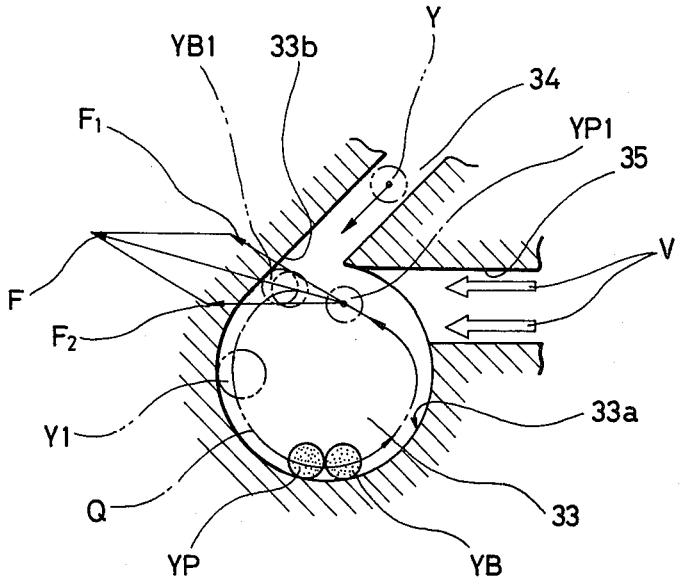
FIG. 10-a
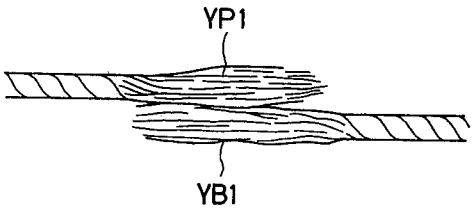
FIG. 10-b
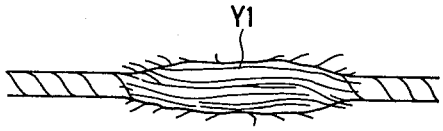
FIG. 10-c
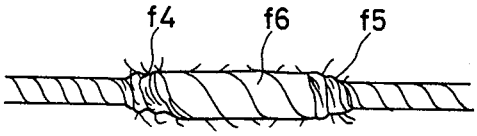

FIG. 11-a FIG. 11-b FIG. 11-c FIG. 11-d
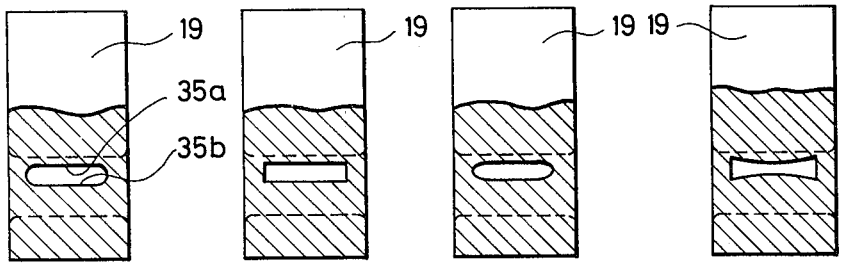
FIG. 11-e
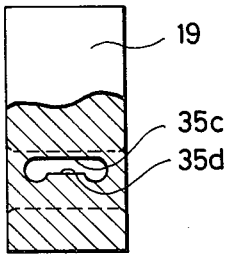
FIG. 12
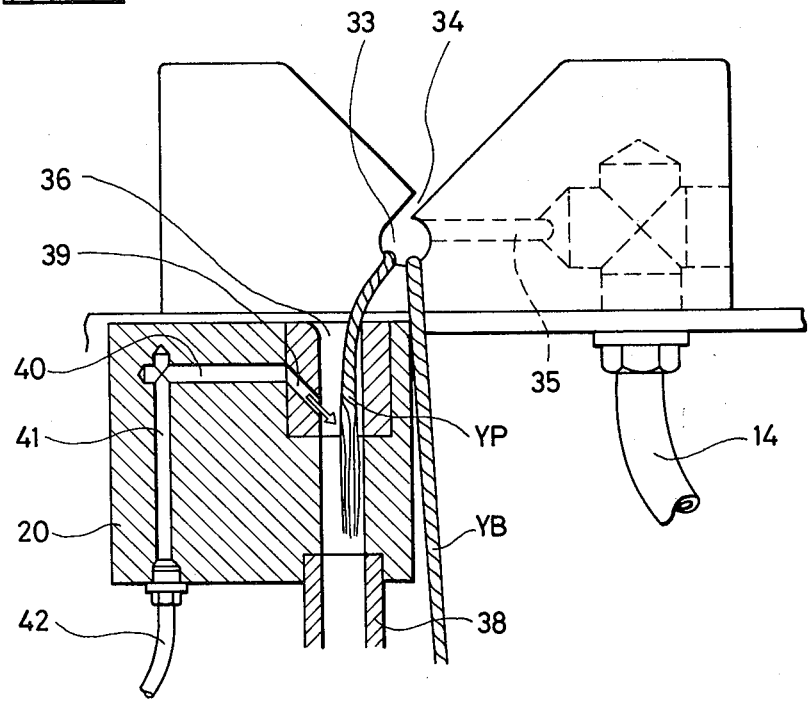

APPARATUS FOR SPLICING SPUN YARNS

BACKGROUND OF THE INVENTION

As the known apparatus for splicing spun yarns, there can be mentioned fisherman's knot as shown in FIG. 1*a* and weaver's knot as shown in FIG. 1*b*. In these knotters, the knotting operation heretofore conducted manually by a worker is performed only mechanically and the structure of the formed knot is not different from that of the knot manually formed by the worker. Such fisherman's or weaver's knot can comply with mass production by mechanization, but since increase of the knot strength alone is mainly intended in such yarn-tying apparatus, the size of the knot becomes as large as about 3 times the diameter of the single yarn, and any particular consideration is not paid to this increased size of the knot. This has serious influences on the subsequent processing steps. For example, the size of the knot which is about 3 times the diameter of the single yarn causes breakage on knitting needles at the knitting step, inhibiting continuous operation of the machine, and a perforated knitted fabric is readily formed. Furthermore, in an air or water jet loom, the yarn end projecting from a weft falls in contact with a warp forming a shed and there occurs an undesirable phenomenon in which the weft does not arrive at the fabric end. Moreover, knots appearing on the woven fabric as the final product are regarded as defects and it is necessary to perform a post treatment of removing a knot-appearing portion from the woven fabric or pushing the knots toward the back side of the fabric.

As means for eliminating the foregoing defects, there has been proposed a yarn-splicing apparatus which provides a knot structure quite different from the knot structure produced by the fisherman's knotter or weaver's knotter. According to this proposal, a fluid is jetted on lapped yarn ends to mingle the yarn ends and entangle fibers of the yarn ends to effect knotting. The knot structure thus produced is in principle as shown in FIG. 1*c*. After the yarn ends have been mingled with each other, the fibers of both the yarn ends are entangled with one another and certain twists are given to the fibers, whereby an integrated knot structure is formed. Accordingly, the knot produced by such air knotter comprises entangled portions f1 and f2 present in the vicinity of the yarn ends and a twisted portion f3 located between the entangled portions f1 and f2.

As pointed out hereinbefore, the size of the knot formed by the fisherman's or weaver's knotter is at least about 3 times the diameter of the single yarn. In contrast, the size of the knot formed by the air knotter is not larger than about 1.5 times the diameter of the single yarn. Supposing that the ends of a single yarn having a diameter d1 and a sectional area A1, are spliced by the air knotter to form a knot having a diameter d2 and a sectional area A2, since A1 is equal to $\pi/4$ d1$^2$ and A2 is equal to the sum of the sectional areas of the two single yarns, A2 is expressed as follows:

$$A2 = A1 + A1 = (\pi/4)\,d1^2 + (\pi/4)\,d1^2 \quad (1)$$

$$A2 = (\pi/4)\,d2^2 \quad (2)$$

From the formula (1) and (2), the following relation is derived:

$$\frac{\pi}{4} d1^2 + \frac{\pi}{4} d1^2 = \frac{\pi}{4} d2^2$$

$$\frac{\pi}{2} d1^2 = \frac{\pi}{4} d2^2$$

$$d2 = \sqrt{2}\, d1$$

Accordingly, the size d2 of the knot is $\sqrt{2}$ times the size f1.

The above value is a theoretical value calculated based on the supposition that the two single yarns d1 are completely mingled with each other and the knot has a shape of a true circle. It is estimated that practically, the knot is elliptical more or less. Accordingly, it is estimated that the maximum size of the knot is somewhat larger than $\sqrt{2}$ times the single yarn diameter d1. However, at any rate, this size is about ½ of the size of the fisherman's or weaver's knot, which is about 3 times the single yarn diameter. Therefore, this knotting method can be regarded as an epoch-making yarn tying method.

In connection with the binding strength of the knot formed by tying yarn ends, it is preferred that the strength of the knot be equal to or higher than the strength of the single yarn.

In case of the fisherman's or weaver's knot, it is considered that in principle, the binding strength is equal to or higher than the single yarn strength, though in certain yarns, it happens that the binding strength is lower than the single yarn strength. However, in each of knots formed by various air knotters, the binding strength is lower than the single yarn strength, though the binding strength differs depending on the kind of the yarn, for example, a polyester/cotton mix-spun yarn or an acrylic yarn or on the count number of the yarn. Influences of the count number of the yarn on the binding strength of the knot are especially prominent. More specifically, as the size of the yarn is small, the ratio of the binding strength of the knot to the single yarn strength is relatively high, and a value of 70 to 85% was obtained at experiments.

On the other hand, as the size of the yarn is increased, the above-mentioned ratio is decreased and it often happens that the binding strength is less than 50% of the single yarn strength. Furthermore, it is pointed out that even if the count number is the same, the binding strength varies according to the condition of the knot and the stability of the knot is reduced if the knot condition is bad.

SUMMARY OF THE INVENTION

The present invention relates to an apparatus for splicing spun yarns and more particularly relates to a pneumatic yarn splicing apparatus in which the shape of the jet nozzle is made flat to stabilize the flow of the jetted air stream. An object of the present invention is to provide a pneumatic yarn splicing apparatus by which the yarn splicing operation can be performed very stably and knot having the excellent binding strength can be obtained.

BRIEF DESCRIPTION OF DRAWINGS

FIGS. 1*a* and 1*b* are diagrams illustrating the structure of the knot formed by conventional yarn-tying and FIG. 1*c* is a diagram illustrating the structure of the spliced portion of the present invention;

FIG. 9 is a diagram showing a mode of yarn splicing;

FIGS. 10*a*, 10*b* and 10*c* are diagrams showing the spliced portion;

FIGS. 11*a* to 11*e* are diagrams illustrating the sectional shape of the jet nozzle;

FIG. 12 is a sectional side view showing the control nozzle;

DETAILED DESCRIPTION OF THE INVENTION

The present invention will now be described in detail with reference to the accompanying drawings.

Figure 2:
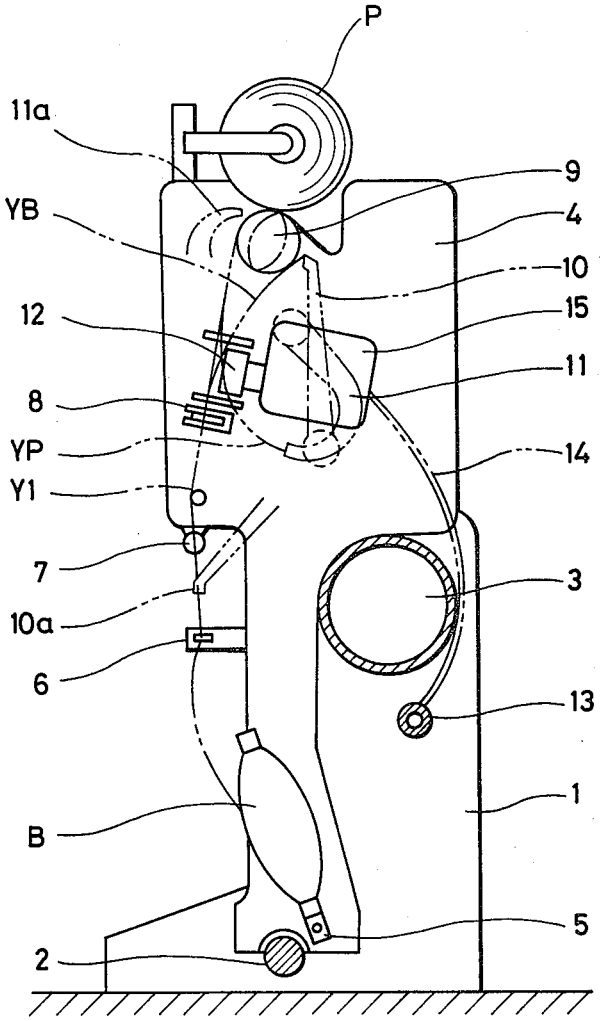
FIG. 2 is a side view diagrammatically illustrating an automatic winder which is provided with the yarn-splicing apparatus of the present invention.

FIG. 2 is a view diagrammatically illustrating an automatic winder to which the present invention is applied. Referring to FIG. 2, a shaft or pipe 2 and a pipe 3 are laid out between every two adjacent frames 1 and a winding unit 4 is rotatably supported on the shaft 2. While the automatic winder is operated the winding unit 4 is placed also on the pipe 3 and appropriately fixed. The pipe 3 is connected to a blower not shown in the drawings and a suction air current always acts on the pipe 3.

In the above-mentioned winding unit 4, rewinding of a yarn to a package P from a bobbin B is conducted in the following manner. More specifically, a yarn Y1 is unwound from the bobbin B on a peg 5 and guided to a tenser 7 through a guide 6, and an appropriate tension is given to the yarn Y1 by the tenser 7. Then, the yarn Y1 passes through a detector 8 detecting yarn unevenness such as slub and also detecting breakage or running of the yarn, and it is then wound onto the package P rotated by a winding drum 9.

When yarn unevenness is detected by the detector 8, a cutter located in the vicinity of the detector 8 is actuated to cut the running yarn Y1 and stop the winding operation. Simultaneously, a first yarn guide suction arm 10 is actuated to guide a yarn YB on the bobbin side to a yarn-splicing apparatus 12 located apart from the ordinary yarn path Y1 and a second guide suction arm 11 is actuated to guide a yarn on the package side to the yarn-splicing apparatus 12. Then, the splicing operation is conducted by the yarn-splicing apparatus 12, and rewinding of the yarn is then started again and continued. The first and second yarn guide suction arms 10 and 11 are connected to the pipe 3 on which the suction air stream acts. Since a fluid such as compressed air is used for the yarn-splicing apparatus, a conduit 14 is laid out between another pipe 13 and a yarn-splicing box 15 and the compressed fluid is supplied to the yarn-splicing apparatus from the pipe 13.

Figure 3:
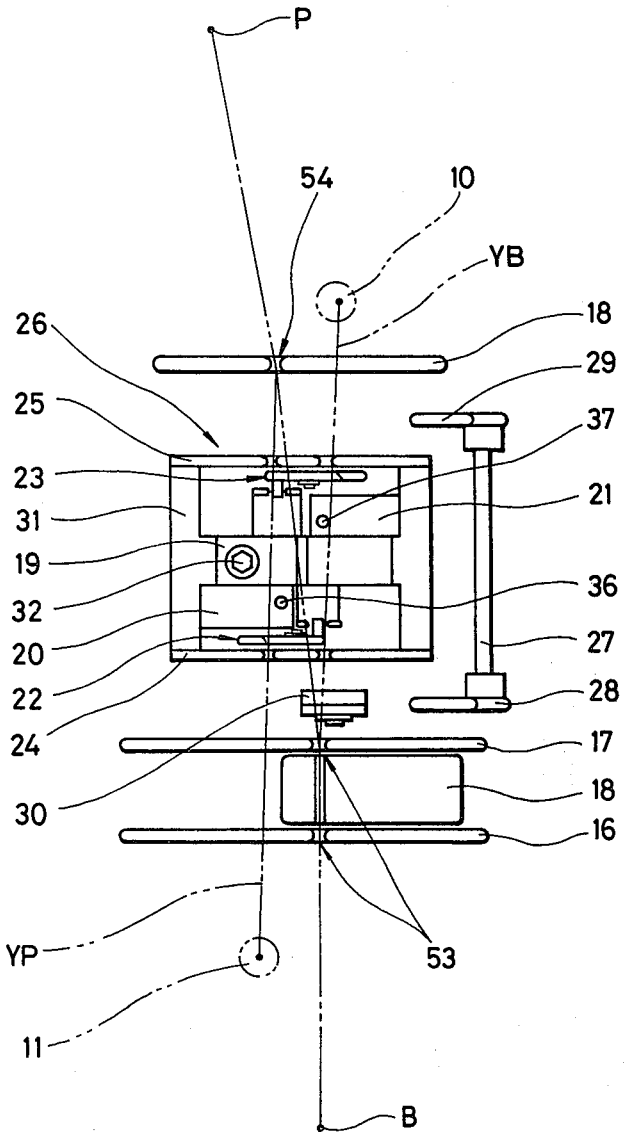
FIG. 3 is a side view showing the entire structure of the yarn-splicing apparatus.
Figure 4:
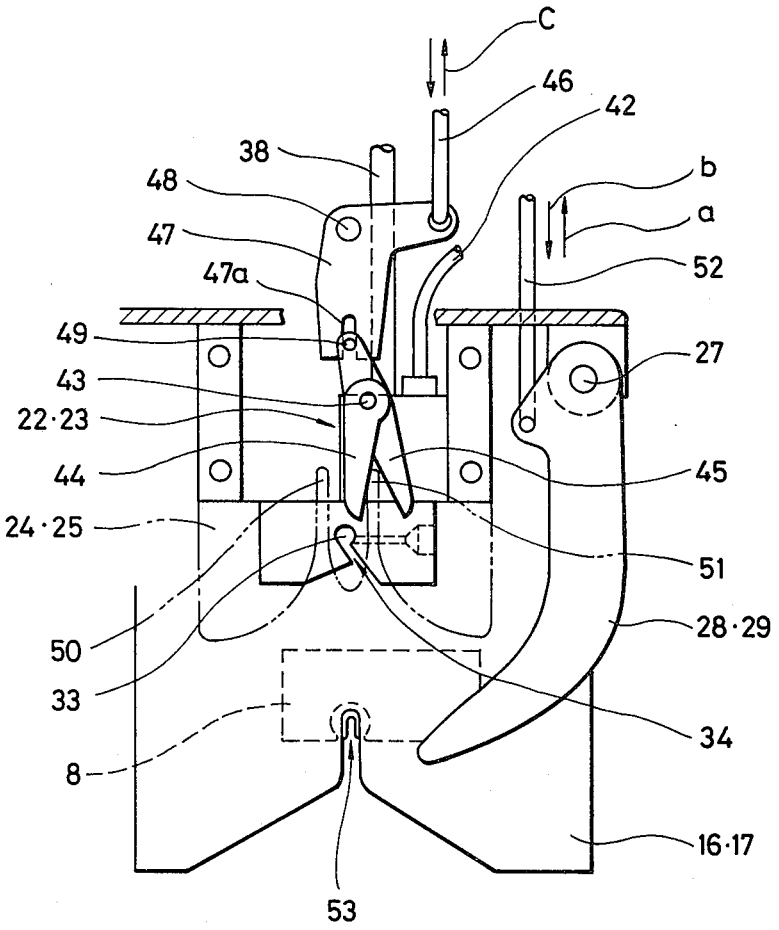
FIG. 4 is a top view of the yarn-splicing apparatus shown in FIG. 3.

The entire structure of the yarn-splicing apparatus 12 is illustrated in detail in FIGS. 3 and 4. During the normal rewinding operation, a yarn Y from the bobbin B passes through the detector 8 and guide plates 16 and 17 disposed before and after the detector 8 and runs along a course from a topmost guide plate 18 to the package P.

The yarn-splicing apparatus 12 is arranged between the guide plates 17 and 18, and the suction openings on the top ends of the first and second suction arms 10 and 11 are turned so that they intersect each other and they suck the ends of yarns YB and YP on the bobbin side and package side. The suction openings are turned to the outsides of the upper and lower guide plates 16 and 18 stopped there. A yarn-splicing member 19 is arranged substantially at the center of the yarn-splicing apparatus 12, and splicers and two yarn-splicing control nozzles 20 and 21 described hereinafter are arranged to grip the yarn-splicing member 19 therebetween.

On the outsides of the control nozzles 20 and 21, yarn-cutting devices 22 and 23 are arranged and also yarn-splicing guide plates 24 and 25 are arranged to guide the yarns YB and YP on the bobbin side and package side at the yarn-splicing operation. Yarn-gathering levers 28 and 29 turning with a shaft 27 being as the fulcrum are arranged on one side of the yarn-splicing apparatus proper 26 comprising the above-mentioned yarn-splicing member 19, control nozzles 20 and 21, cutting devices 22 and 23 and yarn-splicing guide plates 24 and 25. When the detector 8 detects slub or the like of the yarn Y and the cutting device not shown in the drawings and the suction arms 10 and 11 are actuated to cut the yarn Y and guide the yarn ends YB and YP to the outsides of the guide plates 16 and 18, the yarn-gathering levers 28 and 29 are simultaneously actuated to guide the yarn ends YB and YP to the yarn-splicing apparatus proper 26.

The yarn-gathering levers 28 and 29 turn in the above-mentioned manner until they abut against a stopper 30 having a V-shaped section and being located between the guide plates 17 and 24 and is stopped. Accordingly, the turning region of the yarn-gathering levers 28 and 29 can appropriately be adjusted by adjusting the position of the stopper 30.

The foregoing members will now be described in detail.

Figure 5:
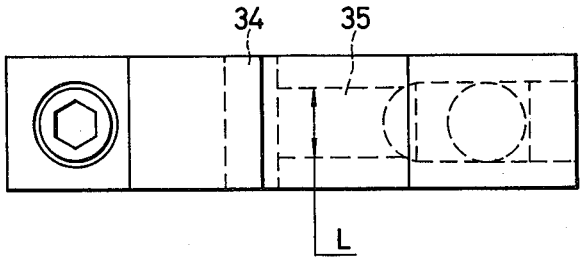
FIG. 5 is a top plan view showing the yarn-splicing member.
Figure 6:
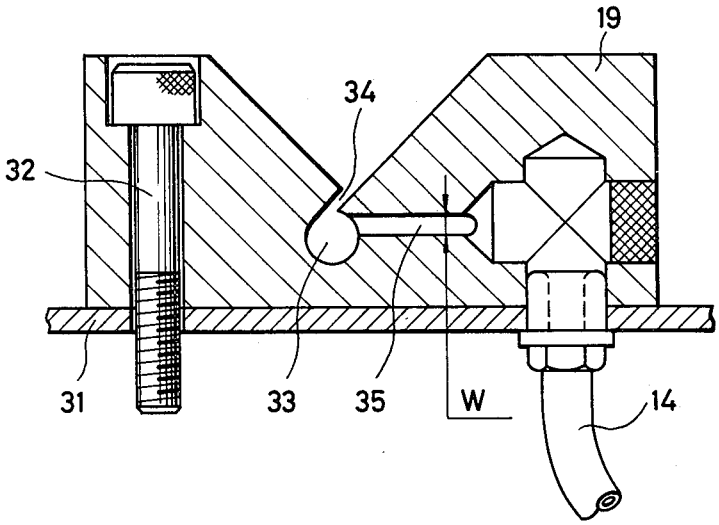
FIG. 6 is a side view of the yarn-splicing member shown in FIG. 5.

The yarn-splicing member 19 is fixed to a bracket 31 by a screw 32, and as shown in FIGS. 5 and 6, a cylindrical yarn-splicing hole 33 is formed substantially at the center of the yarn-splicing member 19 and a slit 34 suitable for inserting the yarn from the outside is formed along the entire tangential direction of the yarn-splicing hole 33. A jet nozzle 35 is arranged so that it is opened tangentially to said hole 33. The jet nozzle 35 is flat and parallel to the central line of the yarn-splicing hole 33. The width W of the nozzle 35 is smaller than $\frac{1}{2}$ of the diameter of the yarn-splicing hole 33 and the length L of the nozzle 35 is larger than said width W. These dimensions are set according to the length of the knot to be formed.

Figure 7:
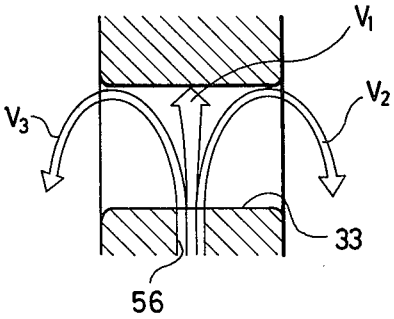
FIG. 7 PRIOR ART
FIG. 7 is a diagram showing a mode of air flow in the conventional nozzle.

The shape and sectional area of the jet nozzle 35 have significant influences on the appearance, shape and binding strength of the joint to be formed. FIG. 7 illustrates the state where a small-diameter cylindrical jet nozzle 56 is disposed substantially at the center in the longitudinal direction of the yarn-splicing hole 33 and FIG. 8 illustrates the state where a flat jet nozzle 35 is disposed according to the present invention.

A compressed fluid jetted from the jet nozzle 56 shown in FIG. 7 is violently expanded on jetting and is thus jetted to the yarn-splicing hole 33. Accordingly, the compressed fluid is jetted in large swiring currents running in the central direction V1 and both the side directions V2 and V3.

Figure 8:
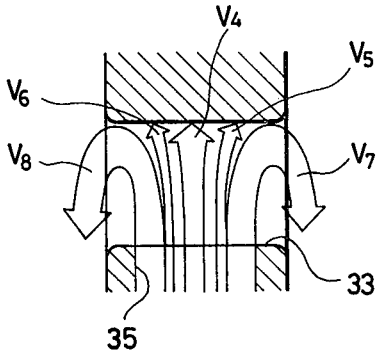
FIG. 8 is a diagram showing a mode of air flow in the nozzle of the present invention.

A compressed fluid jetted from the flat nozzle 35 shown in FIG. 8 is not expanded so violently as the compressed fluid jetted from the cylindrical nozzle 56 shown in FIG. 7 because the jet nozzle is flat and expanded, but currents are increased at points V4, V5 and V6 near the center in the yarn-splicing hole 33 and pitches of axial swiring currents toward both the sides V7 and V8 are reduced. Accordingly, the flow rate should naturally be increased and the compressed fluid is jetted in the form of a laminar flow having a certain width. In case of the cylindrical nozzle 56 shown in FIG. 7, when the size of the yarn is small, for example, the count number of the yarn is about 120, and the length of the knot is short, the yarn-splicing operation can be performed tentatively, but the splicing operation often ends in failure and the binding strength is insufficient, with the result that the operation stability is not satisfactory. On the other hand, in case of the flat jet nozzle 35 shown in FIG. 8, both the small and large yarns can be treated effectively and occurrence of failure in the splicing operation is much reduced as compared with the case of the cylindrical nozzle 56. Furthermore, as will be apparent from the experimental results shown hereinafter, the binding strength is substantially equal to the single yarn strength.

The process of forming joints is illustrated in FIGS. 9 and 10. Yarn ends YB and YP on the sides of the bobbin B and package P, which are to be spliced, are inserted from the slit 34 opened on one end of the yarn-splicing hole 33 and they are placed at a position confronting the opening of the slit 34 of the yarn-splicing hole 33 and kept in contact with the inner circumferential face **33*a* of the yarn-splicing hole 33. When a compressed fluid V is jetted into the yarn-splicing hole 33 in this state, the compressed fluid flows along the inner circumferential face 33*a* of the yarn-splicing hole 33 and when the fluid goes half round the circumference of the hole 33**, the fluid catches the yarn ends YB and YP and continues turning.

When the fluid makes substantially one round, the turning fluid current F1 joins with the fluid current F2 jetted from the jet nozzle **35*a* and the combined current flows with a combined force F of the forces of the turning current F1 and jetted fluid current F2. At this time, the yarn ends YB and YP to be tied move along the locus Q of the fluid, and at the point when the turning current F1 joins with the jetted fluid current F2, the yarn YB first abuts against the inner circumferential face 33*b* at a position slightly inner than the opening of the slit 34 in the yarn-splicing hole 33, and then, the yarn end YP1 moves to abut against the yarn end YB1. At this point, both the yarn ends YB1 and YP1** are mingled and integrated with each other. This action of mingling and integrating the yarn ends YB and YP with each other should be performed at the initial shape of ballooning of the yarn ends. The reason is as described below.

As the yarn end Y1 formed by mingling and integrating the yarn ends YB and YP with each other balloons, the yarn end Y1 is twisted and is entangled on both ends of the given twist. Accordingly, if mingling is effected after balloning is conducted by certain rotations, mingling becomes difficult.

As shown in FIG. **10*a*, before the yarn ends YB and YP to be spliced are introduced into the yarn-splicing hole 33, they are untwisted by the yarn-splicing control nozzled 20 and 21 described hereinafter and the respective fibers are arranged in parallel to one another. At the point when the above-mentioned turing fluid current F1 joints with the current F2 of the fluid jetted from the jet nozzle 35, as shown in FIG. 10*b*, the yarn ends YB1 and YP1** are mingled and integrated with one another.

Then, as shown in FIG. **10*c*, the top ends of both the yarns are entangled with each other by the turning fluid current, and twists f6 are given between entanglements f4 and f5** to complete the yarn-splicing operation.

The sectional shape of the jet nozzle 35 is not particularly critical and various sectional shapes, for example, those shown in FIGS. **11*a* through 11*e*, may be adopted. In FIG. 11*a*, the top face 35*a* and lower face 35*b* are in parallel to each other, and both the ends are defined by curves. In FIG. 11*b*, the section has a rectangular shape and in FIG. 11*c*, the section has an ellipsoidal shape. In FIG. 11*d*, the section has a hand drum-like shape having both the ends tapered, and in FIG. 11*e*, the top face 35*c* and lower face 35*d* are in parallel to each other and both the ends are defined by curves larger than the width between the top and lower faces 35*c* and 35*d*. Incidentally, the fluid is supplied to the above-mentioned nozzle 35 from the pipe 13 shown in FIG. 2 through the conduit 14**.

Referring to FIGS. 3 and 4, nozzle holes 36 and 37 releasing twists on the yarn ends are formed on the yarn-splicing control nozzles 20 and 21 disposed on both the sides of the above-mentioned yarn-splicing member 19. These nozzle holes 36 and 37 are illustrated in detail in FIG. 12.

The yarn ends YB and YP to be spliced are introduced into the nozzle holes 36 and 37 through the yarn-splicing hole 33. Introduction of the yarn ends YB and YP into the nozzle holes 36 and 37 is accomplished by the sucking action of the pipe 3 shown in FIG. 2, which is connected to the nozzle hole 36 through a flexible pipe 38. When the yarn end YP is introduced by the sucking force acting on the nozzle hole 36, the yarn YP is untwisted by a fluid jetted from a jet nozzle 39 slantingly opened to the nozzle hole 36, and the respective fibers are disentangled so that they are substantially in parallel to one another.

Higher effects are obtained when the jet nozzle 39 is formed slantingly to the tangential direction so that a swiring current flowing in the direction opposite to the direction of twists on the yarn is produced. Supply of the fluid to the jet nozzle 39 is accomplished by the pipe 13 connected to a conduit 42 through communication holes 40 and 41 and also through the above-mentioned conduit 14. Incidentally, the nozzle hole 37 has the same structure as that of the nozzle 36 and exerts the same function as that of the nozzle 36.

Referring to FIGS. 3 and 4, the cutting device 22 and 23 have scissors-like form, and a movable blade 45 turns with a pin 43 being as the fulcrum so that the movable blade 45 intersects a stationary blade 44, whereby the yarn Y is cut.

When a rod 46 is actuated by a control cam not shown in the drawings, a fork-like bifurcate lever 47 turns in the clockwise of counterclockwise direction with a shaft 48 being as the fulcrum, and a bifurcate fork 47*a* moves a pin 49 on the other end of the movable blade 45 to actuate the movable blade 45.

The guide plates 24 and 25 are disposed on the outer sides of the cutting devices 22 and 23, and each guide plate has guide grooves 50 and 51. The yarn-gathering levers 28 and 29 are fixed to the shaft 27, and a rod 52 is actuated by the control cam not shown in the drawings to turn in the clockwise direction with the shaft 27 being as the fulcrum, whereby the yarn ends YB and YP are inserted in the guide grooves 50 and 51.

The operations will now be described.

Referring to FIGS. 2 through 4, when the detector 8 for detecting breakage of a yarn being rewound or absence of a yarn on the bobbin detects that the yarn does not run, the drum 9 is stopped and a one-rotation clutch not shown in the drawings is actuated, and by various control cams mounted on a shaft rotated through said clutch or various control cams co-operative with said shaft, the yarn-splicing operation is accomplished.

At first, the first and second yarn guide suction arms turn from the positions 10*a* and 11*a* in the state where the yarn ends are sucked on these suction arms, and the yarn end YB on the side of the bobbin B and the yarn end on the side package P are guided to the yarn-splicing apparatus 12 while both the yarn ends YB and YP intersect one another. At this point, the yarn end YB on the side of the bobbin B is located in the state sucked on the suction arm 10 through the guide grooves 53 of the guide plates 16 and 17, and the yarn end YP on the side of the package P is located in the state sucked on the suction arm 11 through the guide groove 54 of the guide plate 18.

Figure 13:
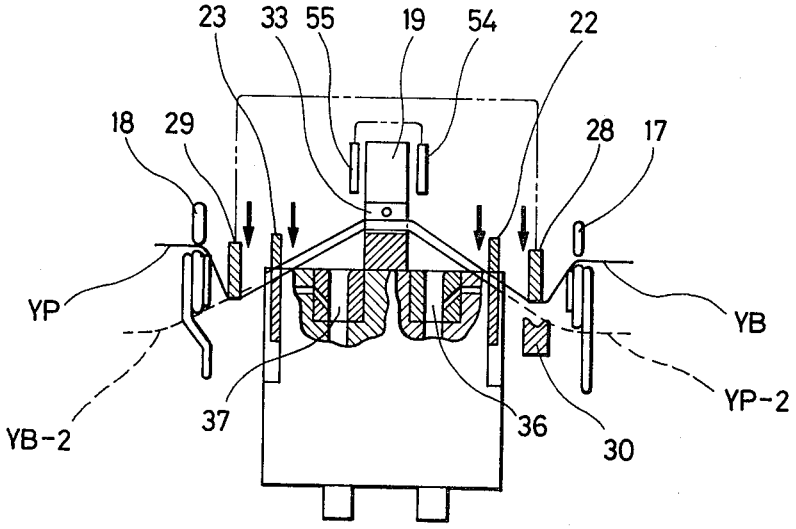
FIGS. 13 through 15 are diagrams illustrating the yarn-splicing operation.

When the yarn end YB on the side of the bobbin B and the yarn end YP on the side of the package P are located on the yarn-splicing apparatus proper 26 in the state where they intersect one another, as shown in FIG. 13, by retreating of the rod 52 in the direction of arrow a in FIG. 4 by the action of the control cam not shown in the drawings, the yarn-gathering levers 28 and 29 are rotated in the clockwise direction with the shaft 27 being as the fulcrum, whereby the yarn ends YB and YP are guided to the guide grooves 50 and 51 of the yarn-splicing guide plates 24 and then guided to the yarn-splicing hole 33 of the yarn-splicing member 19 through the slit 34. Then, the yarns YB and YP are cut (YB-2 and YP-2) at predetermined positions apart from the yarn-splicing member 19 by the cutting devices 22 and 23. The yarn-cutting positions are very important because they have a relation to the length of the joint and have influences on the appearance, touch and binding strength of the joint formed by the yarn-splicing operation, and these positions are changed according to the count number of the yarn.

The operations of the cutting devices will now be described. As shown in FIG. 4, when the rod 46 is retreated in the direction of arrow c by the action of the control cam not shown in the drawings, the bifurcate lever 47 turns in the counterclockwise direction with the shaft 48 being as the fulcrum, and furthermore, the movable blade 45 turns in the clockwise direction with the pin 49 being as the fulcrum so that the movable blade 45 intersects the stationary blade 44, whereby cutting of the yarn Y is performed.

Figure 14:
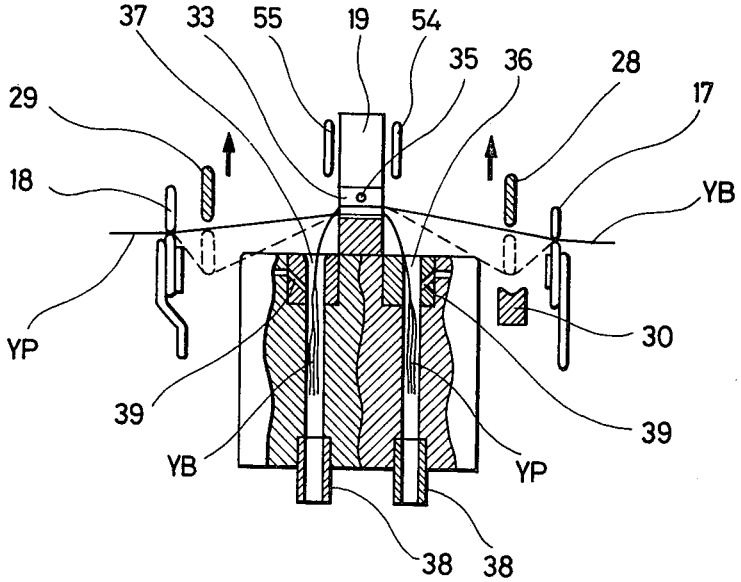

Then, as shown in FIG. 14, the sucking force is imposed on the sucking nozzle holes 36 and 37 of the control nozzles 20 and 21 by the sucking action of the pipe 3 connected to the nozzle holes 36 and 37 through the flexible pipe 38, and simultaneously with or before or after this sucking action, the yarn-gathering levers 28 and 29 are advanced in the direction separating from the yarn Y, that is, the rod 52 shown in FIG. 4 is advanced in the direction of arrow b, whereby the levers 28 and 29 are turned in the counterclockwise direction with the shaft 27 being as the fulcrum. By this turning of the levers 28 and 29, both the yarn ends YB and YP are sucked in the nozzle holes 36 and 37 by the sucking force acting on the nozzle holes 36 and 37. When the yarn ends YB and YP are sucked in the nozzle holes 36 and 37, as shown in FIG. 12, the fluid is supplied into the communication holes 40 and 41 from the pipe 13 through the conduit 42 and is jetted from the jet nozzle 39. When the fluid jetted from the jet nozzle 39 is caused to act on the yarn ends YB and YP, twists in the vicinity of the yarn ends, that is, in the portion corresponding to the length for yarn-splicing, are substantially released and the respective fibers are disentangled in the substantially partallel state suitable for yarn-splicing.

The sucking action on the nozzle holes 36 and 37 and the supply of the fluid to the jet nozzle 39 are accomplished by changing over valves by solenoids.

Figure 15:
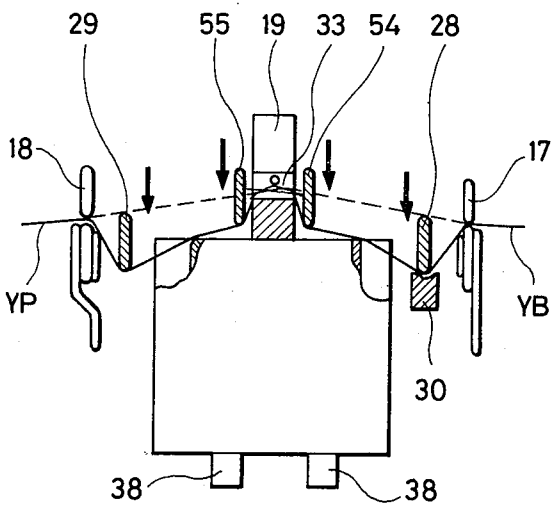

The yarn ends YB and YP are thus disentangled in a condition suitable for yarn-splicing, and the sucking action on the nozzle holes 36 and 37 and the supply of the fluid to the jet nozzle 39 are then stopped. Simultaneously with or before or after this stoppage, as shown in FIG. 15, the yarn-gathering levers 28 and 29 are turned again and moved to the position abutting against the stopper 30 while guiding the yarn ends YB and YP. Then, the splicers 54 and 55 disposed on both the sides of the yarn-splicing member 19 rotatably with a shaft not shown in the drawings being as the center move in the same direction as the direction of the movement of the yarn-gathering levers 28 and 29 while guiding the yarn ends.

By the above-mentioned movements of the yarn-gathering levers 28 and 29 and the splicers 54 and 55, the yarn ends YB and YP inserted in the nozzle holes 36 and 37 are attracted into the yarn-splicing hole 33, the disentangled yarn end portions to be spliced are set in the lapped state in the yarn-splicing hole 33, namely in the state shown in FIG. 10*c*.

When the yarn ends YB and YP are thus set in the lapped state in the yarn-splicing hole 33, a compressed fluid is caused to act on the nozzle 35 of the yarn-splicing member 19, and the yarn-splicing operation is performed according to the procedures described hereinbefore with reference to FIGS. 7 through 10. When the yarn-splicing operation is completed, the yarn-gathering levers 28 and 29 and the splicers 54 and 55 separate from the yarn Y, and the yarn Y passes through the slit 34 of the yarn-splicing member 19 and the above-mentioned normal rewinding state is restored.

Figure 16A:
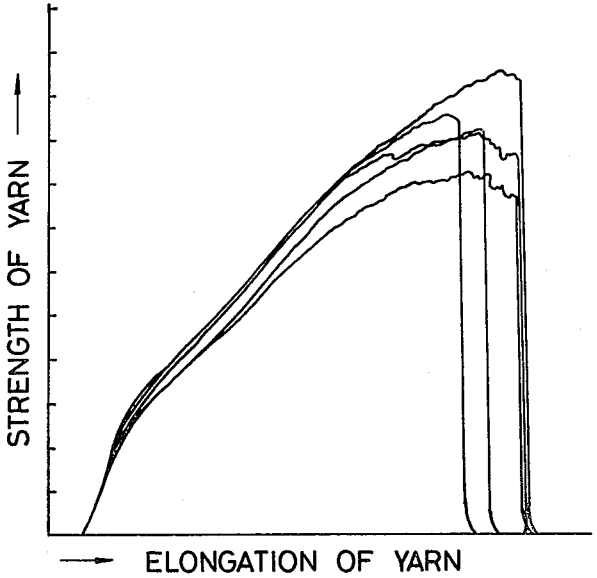
FIGS. 16*a* and 16*b* are diagrams illustrating the results of the measurement of the binding strength of joints formed according to the present invention.
Figure 16B:
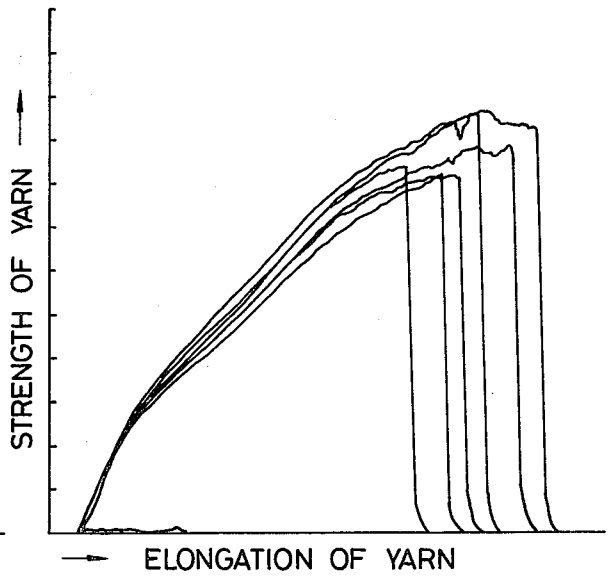

FIG. 16 illustrates the results of the experiments conducted by using the apparatus of the present invention. More specifically, FIG. 16*a* shows the results of the measurement of the single yarn strength and FIG. 16*b* shows the results of the measurement of the binding strength of the joint formed by the above-mentioned yarn-splicing operation. From these results, it is seen that the strength of the knot is not substantially different from the strength of the single yarn and good results can be obtained according to the present invention.

The foregoing experimental results are tkose obtained at experiments made on acrylic-nylon mix-spun yarns having a relatively large count number of 11. Needless to say, the present invention can be applied to other various yarns differing in the size and kind.

As will be apparent from the foregoing description, according to the present invention, the size of the joint formed by the yarn-splicing operation is maintained at less than ½ of the size of the conventional fisherman's knot or weaver's knot, and simultaneously, the defect of the knot formed by the conventional air knotter, that is, the poor bonding strength of the knot, can be eliminated by adoption of a flat jet nozzle in the yarn-splicing member. More specifically, as is apparent from the foregoing experimental results, the binding strength of the joint formed according to the present invention is not substantially different from the single yarn strength. Furthermore, the shape of the jet nozzle is made flat as mentioned above, the flow of the jetted stream is stabilized and failure in the yarn-splicing operation hardly occurs, and the yarn-splicing operation can be performed vary stably according to the present invention.

What is claimed is:

1. A pneumatic yarn splicing apparatus for spun yarns which includes yarn-cutting devices, yarn end control nozzles and a yarn-splicing member arranged between the control nozzles and is located at a position deviating from an ordinary yarn path of an automatic winder, characterized in that a cylindrical yarn-splicing hole for insertion of a yarn end on the bobbin side and a yarn end on the package side is formed through the yarn-splicing member, a yarn-inserting slit is formed on the yarn-splicing hole along the longitudinal direction thereof, and a flat jet nozzle intersecting the lengthwise direction of the yarn-splicing hole at a right angle and having a section of which width is smaller than ½ of the diameter of the yarn-splicing hole and of which length is larger than said width is tangentially opened on the yarn splicing hole.

2. A pneumatic yarn splicing apparatus as claimed in claim 1, wherein the dimentions of the section of said flat jet nozzle are set according to the length of the joint of spun yarns to be formed.

3. A pneumatic yarn splicing apparatus as claimed in claim 1, wherein the sectional shape of said flat jet nozzle is defined by the top face and lower face being in parallel to each other, and curves connecting the ends of the top face and lower face.

4. A pneumatic yarn splicing apparatus as claimed in claim 1, wherein the sectional shape of said flat jet nozzle is a rectangular shape.

5. A pneumatic yarn splicing apparatus as claimed in claim 1, wherein the sectional shape of said flat jet nozzle is an ellipsoidal shape.

6. A pneumatic yarn splicing apparatus as claimed in claim 1, wherein the section of said flat jet nozzle has a hand drum-like shape having both the ends tapered.

7. A pneumatic yarn splicing apparatus as claimed in claim 1, wherein the sectional shape of said flat jet nozzle is defined by the top face and lower face being in parallel to each other, and curves being larger than the width between the top face and lower face and connecting the ends of the faces.

* * * * *